US011597566B2

(12) United States Patent
Yu

(10) Patent No.: US 11,597,566 B2
(45) Date of Patent: Mar. 7, 2023

(54) SEAL BOX WITH GOOD SEALING EFFECT AND EASY TO OPEN

(71) Applicant: Qinghe Yu, Chaozhou (CN)

(72) Inventor: Qinghe Yu, Chaozhou (CN)

( * ) Notice: Subject to any disclaimer, the term of this patent is extended or adjusted under 35 U.S.C. 154(b) by 0 days.

(21) Appl. No.: 17/329,203

(22) Filed: May 25, 2021

(65) Prior Publication Data

US 2021/0276766 A1 Sep. 9, 2021

(30) Foreign Application Priority Data

May 7, 2021 (CN) ..... 202110496122.4

(51) Int. Cl.
*B65D 43/02* (2006.01)
*B65D 43/06* (2006.01)

(52) U.S. Cl.
CPC ..... *B65D 43/0208* (2013.01); *B65D 43/065* (2013.01); *B65D 2543/00194* (2013.01); *B65D 2543/00518* (2013.01); *B65D 2543/00537* (2013.01); *B65D 2543/00555* (2013.01); *B65D 2543/00962* (2013.01)

(58) Field of Classification Search
CPC .. B65D 43/0208; B65D 43/26; B65D 43/265; B65D 43/267; B67B 7/15; B67B 7/14
See application file for complete search history.

(56) References Cited

U.S. PATENT DOCUMENTS 7,784,633 B2 * 8/2010 Luburic ..... B65D 43/0212 81/3.15
2020/0002061 A1 * 1/2020 Samartgis ..... B65D 43/267

* cited by examiner

*Primary Examiner* — Jeffrey R Allen

(57) ABSTRACT

A seal box with a good sealing effect and easy to open comprises a box body and a sealing cover, wherein the box body is formed with an opening, a sealing mechanism is disposed between the opening of the box body and the sealing cover, the sealing cover is detachably mounted at the opening of the box body, and the sealing mechanism is in a locked and sealed state; and a quick opening mechanism is further disposed between the box body and the sealing cover. By means of the quick opening mechanism, users can easily and quickly operate the operating end of an opening element to force the parts, between the area where the opening end is located of the sealing cover and the opening of the box body, of the sealing mechanism to be separated.

6 Claims, 10 Drawing Sheets

SEAL BOX WITH GOOD SEALING EFFECT AND EASY TO OPEN

BACKGROUND OF THE INVENTION

1. Technical Field

The invention relates to a seal box with a good sealing effect and easy to open, in particular to a seal box with a good sealing effect and easy to open, a sealing cover of which can be opened quickly and easily.

2. Description of Related Art

Sealed containers, such as preservation boxes, fulfill a sealing effect traditionally in the following manner: the cover and the box are in press fit or are connected in a threaded manner, wherein the cover and the box are in press fit means that the box opening and the box cover are in close fit and are mutually clamped, which makes it difficult to open the box; and threaded connection is only suitable for circular box openings and circular box covers and is not beneficial to fabrication and use. So, in recent years, a flange-buckle structure is commonly adopted. That is, a clip is disposed on the outer wall of the box opening, a flange to be pulled is disposed on the edge of the box body and is provided with a buckle or a hole, and the buckle or the hole is matched with the clip to tightly connect the box and the cover. This technique has the following advantages: using is convenient; the flange-buckle structure is suitable for boxes of different shapes (square and round boxes), and particularly, the hole is formed in the flange on the edge of the box cover, and the clip is clamped in the hole to realize firm connection. But, this technique has the defect that the box cover cannot be opened with a single hand due to the unreasonable structural design of the flange.

For example, Chinese patent document Application No. CN101164833A and entitled "Buckling structure and seal box with same" discloses a seal box structure, wherein the buckling structure is provided with a buckling flange extending outwards relative to the periphery of a cover and a hinge portion for connecting the buckling flange to the periphery of the cover, at least one buckle portion is disposed below the buckling flange to buckle and fasten the cover; and the hinge portion is formed with a plurality of thin slots which reduce the hinge area for connecting the bucking flange and the cover. The seal box comprises the buckling structure and a container body, wherein a fastening structure is disposed close to the top edge and is matched with the buckle portion to fasten and fix the cover to the container body.

The above-mentioned box cannot be easily opened by users. When opening the cover, the users have to fix the container body with one hand and pull the buckling flange with the other hand, and it takes a long time for the users to pull the buckling flange strenuously to open the cover. The seal box of such a structure is difficult to open, thus causing great inconvenience to the users; and particularly, when the users are very busy or hold other articles with one hand, it is impossible for the users to open the cover with both hands. Thus, all existing seal boxes with a sealing structure having a good sealing effect have the problem of being difficult to open.

BRIEF SUMMARY OF THE INVENTION

The objective of the invention is to provide a seal box with a good sealing effect and easy to open. The seal box with a good sealing effect and easy to open has a good sealing effect and is easy to open. The technical solution adopted by the invention is as follows:

A seal box with a good sealing effect and easy to open comprises a box body and a sealing cover, wherein the box body is formed with an opening, a sealing mechanism is disposed between the opening of the box body and the sealing cover, the sealing cover is detachably mounted at the opening of the box body, and the sealing mechanism is in a locked and sealed state; a quick opening mechanism is further disposed between the box body and the sealing cover and comprises an opening base and an opening element, the opening base is disposed at the top of an outer wall of the box body, the middle of the opening element is rotatably mounted on an edge of the sealing cover, two ends of the opening element are an opening end and an operating end respectively, the opening end is located on a top surface of the opening base, and the operating end is away from the top surface of the opening base; when the sealing cover is to be opened, a user pulls the operating end to enable it to rotate, and then the opening end presses against the top surface of the opening base to force parts, between an area where the opening end is located of the sealing cover and the opening of the box body to be separated to allow the user to perform further operations to open the sealing cover; because the user cannot operate the sealing mechanism when the sealing mechanism is in the locked and sealed state, the quick opening mechanism is configured to unlock the sealing mechanism at a certain position to separate the parts of the sealing mechanism at this position, so that the user can perform further operations at this position to completely unlock the sealing mechanism, and then the sealing cover is completely disassembled; based on the lever principle, the quick opening mechanism simplifies the operations and destroys the locked and sealed state of the sealing cover to allow the sealing cover to be opened easily, quickly and effortlessly.

In one solution, the opening element is shaped like a straight plate, the opening end of the opening element protrudes downwards, and a bottom surface of the operating end of the opening element is close to a top surface of the sealing cover. In this way, the opening element can be supported by the top surface of the sealing cover, thus being prevented from shaking and being easy to store and carry.

In a preferred solution, a curved surface in smooth transition is disposed an outer side of the opening end of the opening element. The curved surface in smooth transition can effectively protect the opening end against damage when the opening end contacts with the top surface of the opening base.

In a preferred solution, an oblique surface inclining upwards is disposed at a bottom of the operating end of the opening element. Users can easily insert their fingers into a gap between the operating end of the opening element and the top surface of the sealing cover through the oblique surface to pull the operating end of the opening element upwards.

In another solution, the opening element is shaped like 7, the opening element comprises an operating section extending vertically and an opening section extending horizontally, a corner of the opening element is rotatably mounted on the edge of the sealing cover, the operating end of the opening element is located at a bottom end of the operating section, and the opening end of the opening element is located at a tail end of the opening section.

In a more preferred solution, the opening end of the opening element is semi-cylindrical. By designing the opening end to be semi-cylindrical, the sliding friction between the opening end and the top surface of the opening base makes operation smoother when the opening end presses against the top surface of the opening base, and the opening end is less likely to be damaged.

In a more preferred solution, the opening end is formed with a plurality of grooves, so that materials can be effectively saved.

In a more preferred solution, a locking piece for locking a bottom surface of the opening base is dispose on an inner wall of the operating section. When the operating section is vertically downwards and is in a non-open state, the locking piece locks the bottom surface of the opening base, so that the opening element is prevented from shaking and is easy to store and carry.

In a more preferred solution, the sealing mechanism comprises a female sealing unit and a male sealing unit, wherein the male sealing unit is disposed at the opening of the box body, and the female sealing unit is disposed on a bottom surface of the sealing cover.

In a more preferred solution, the male sealing unit comprises a circular sealing edge and a buckle, the circular sealing edge is fixed to the opening of the box body, and the buckle is disposed on an outer wall of the circular sealing edge; and the female sealing unit comprises a circular sealing slot and a clamping groove allowing the buckle to be clamped therein, the circular sealing slot is fixed to the bottom surface of the sealing cover, and the clamping groove is formed in an inner wall of the circular sealing slot. When placed at the opening of the box body, the sealing cover is pressed downwards to force the circular sealing edge to be inserted into the circular sealing slot in the bottom surface of the sealing cover, the buckle is clamped in the clamping groove, and the sealing cover completely seals the opening in the top end of the box body.

In a more preferred solution, the circular sealing slot of the female sealing unit comprises an outer slot plate and an inner slot plate, the clamping groove is formed in an inner wall of the outer slot plate, and a curved sealing surface capable of abutting and pressing against an inner wall of the buckle is disposed on an inner wall of the inner slot plate.

Compared with the prior art, the invention has the following beneficial effects: by means of the quick opening mechanism, users can easily and quickly operate the operating end of the opening element to force the parts, between the area where the opening end is located of the sealing cover and the opening of the box body, of the sealing mechanism to be separated, and then, the users perform further operations to open the sealing cover; and operations are extremely easy and quick, the sealing cover can be opened rapidly, and the quick opening mechanism is particularly suitable for seal boxes with a sealing mechanism having a good sealing effect.

DETAILED DESCRIPTION OF THE INVENTION

Embodiment 1

Figure 1:
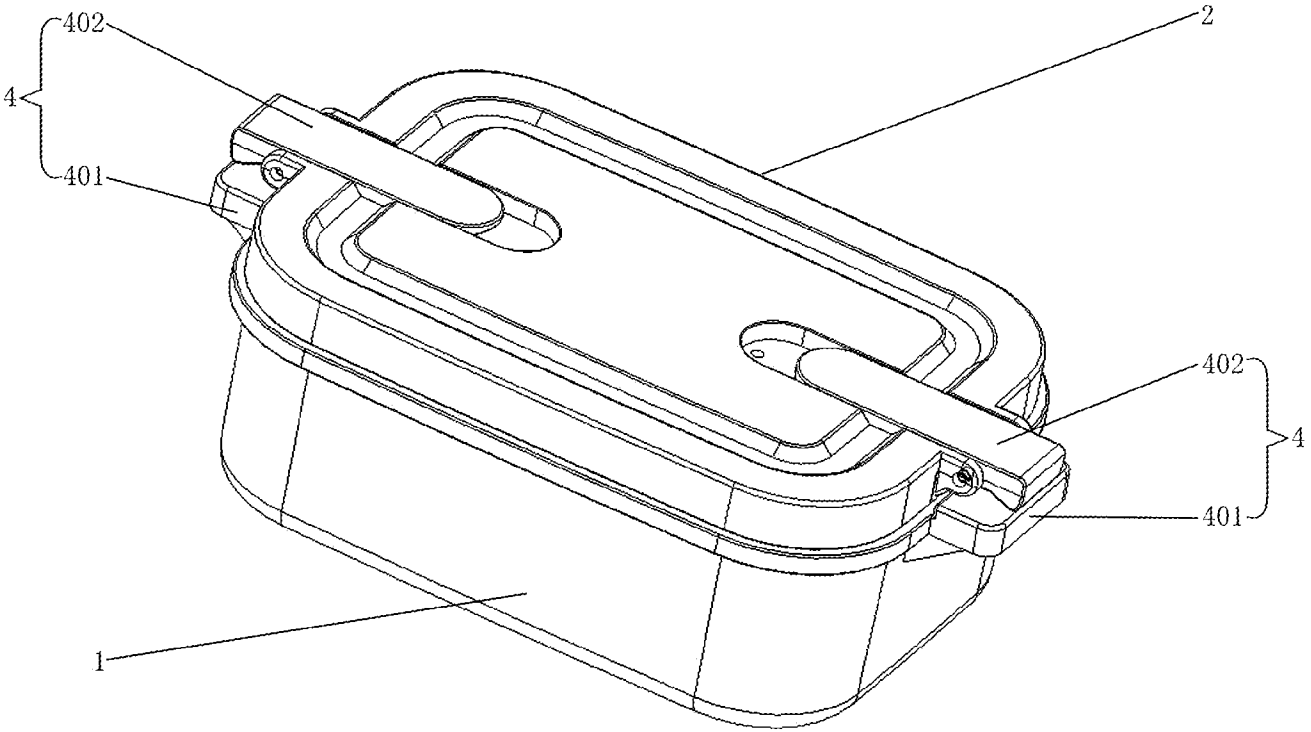
FIG. 1 is a structural diagram of Embodiment 1 of the invention.
Figure 2:
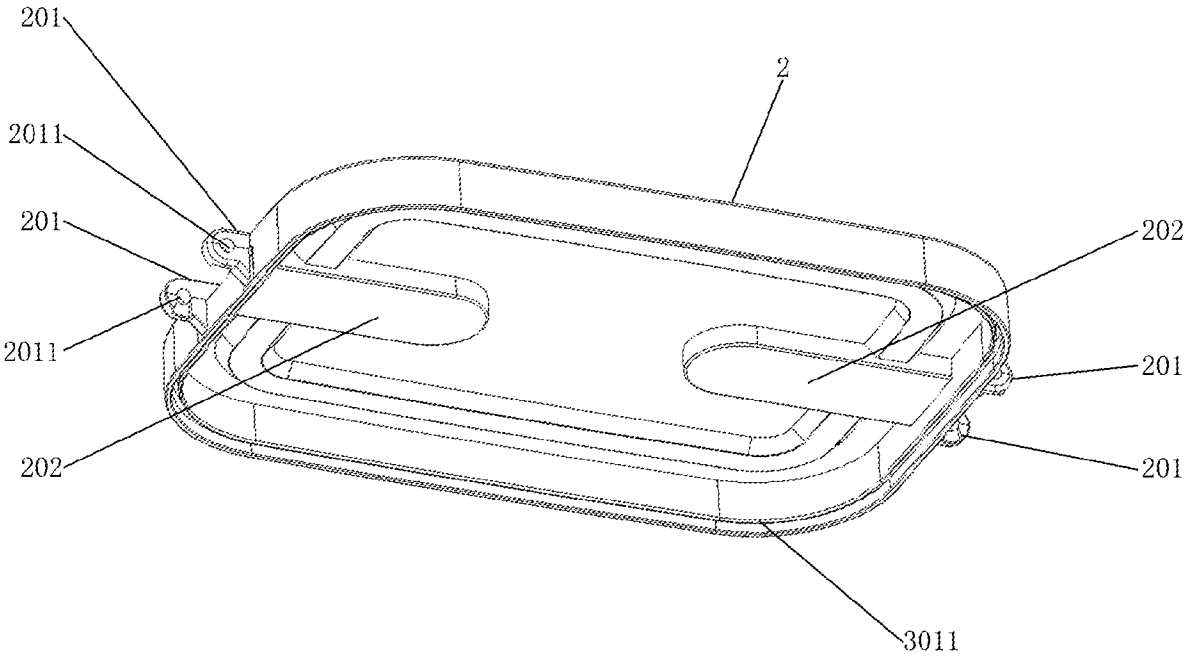
FIG. 2 is a structural diagram of a box body in Embodiment 1 shown in FIG. 1.
Figure 3:
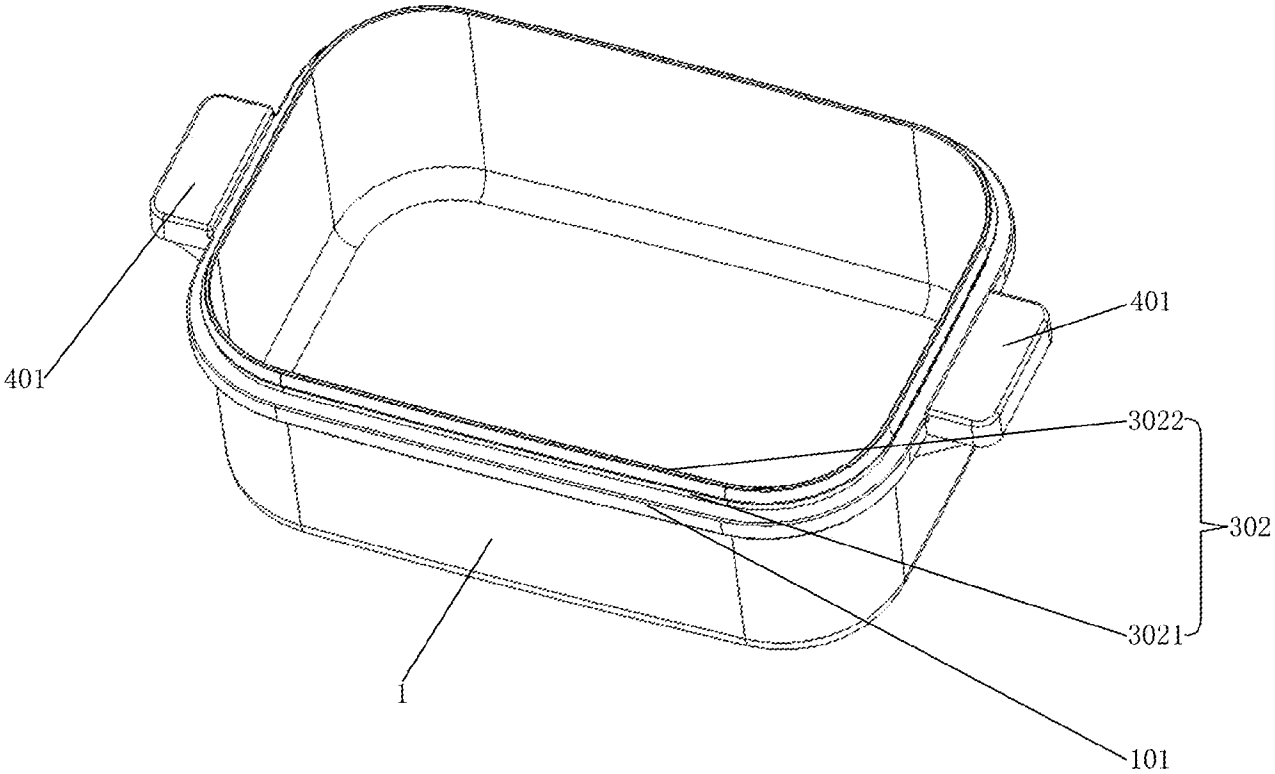
FIG. 3 is an upward perspective view of a sealing cover of Embodiment 1 shown in FIG. 1.
Figure 4:
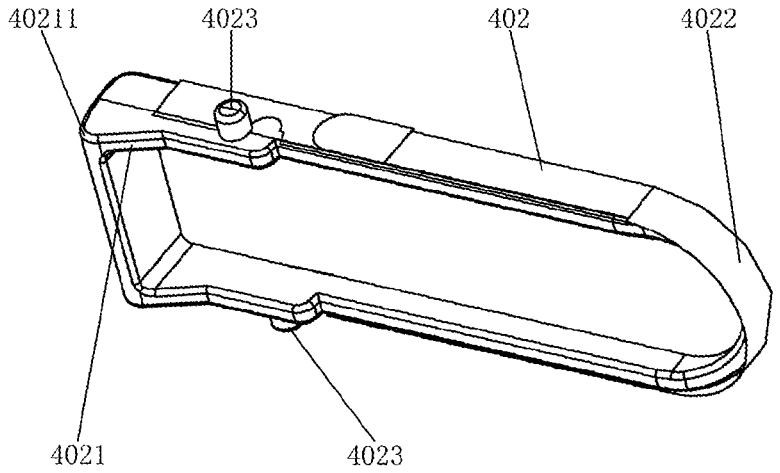
FIG. 4 is an upward perspective view of an opening element in Embodiment 1 shown in FIG. 1.
Figure 5:
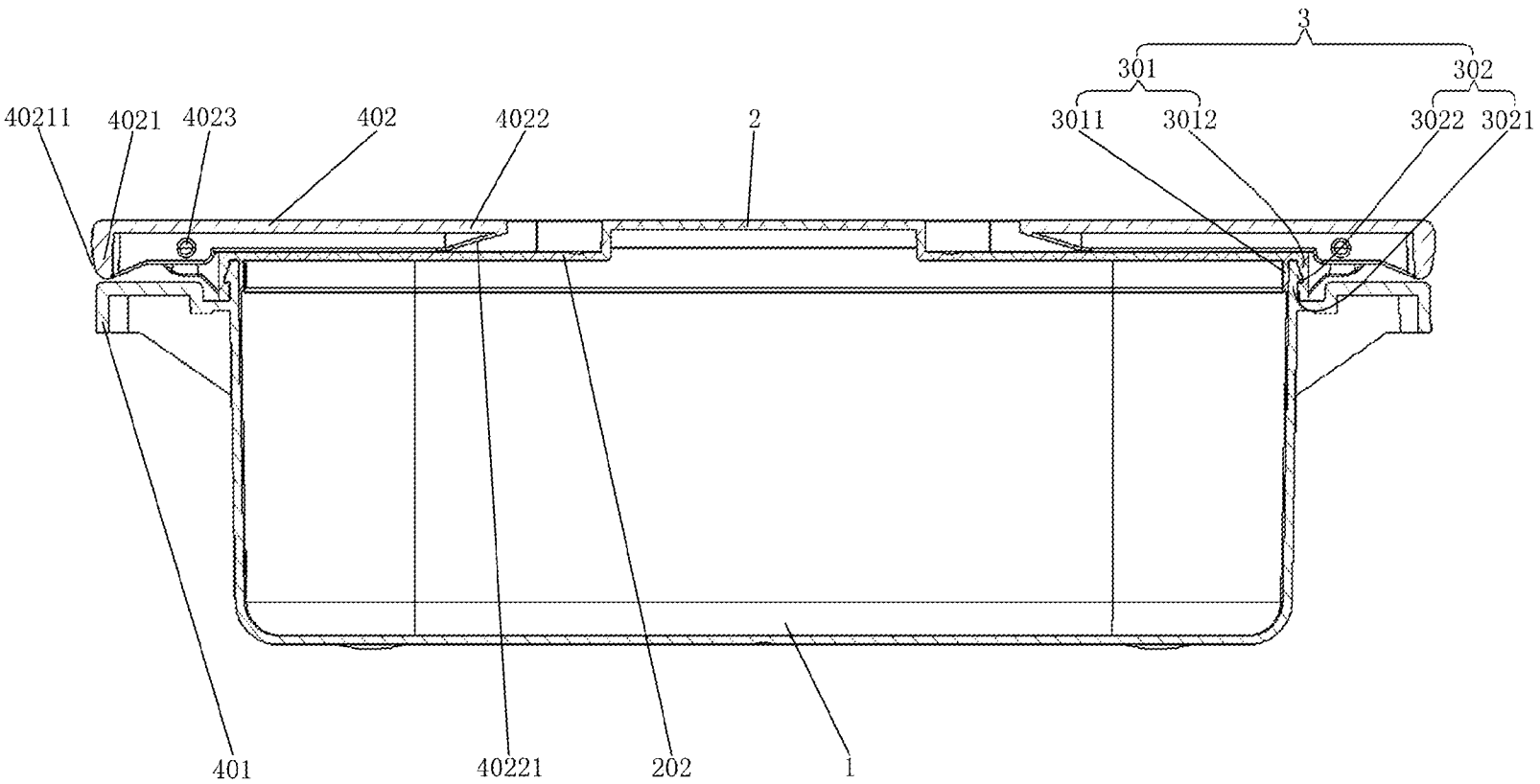
FIG. 5 is a sectional view of Embodiment 1 shown in FIG. 1.

As shown in FIG. 1-FIG. 5, this embodiment provides a seal box with a good sealing effect and easy to open. The seal box with a good sealing effect and easy to open comprises a box body 1 and a sealing cover 2, wherein the box body 1 is formed with an opening 101, a sealing mechanism 3 is disposed between the opening 101 of the box body 1 and the sealing cover 2, the sealing cover 2 is detachably mounted at the opening 101 of the box body 1, and the sealing mechanism 3 is in a locked and sealed state.

The sealing mechanism 3 comprises a female sealing unit 301 and a male sealing unit 302, wherein the male sealing unit 302 is disposed at the opening 101 of the box body 1, and the female sealing unit 301 is disposed on a bottom surface of the sealing cover 2.

The male sealing unit 302 comprises a circular sealing edge 3021 and a buckle 3022, wherein the circular sealing edge 3021 is fixed to the opening 101 of the box body 1 (in this embodiment, the circular sealing edge 3021 and the box body 1 are integrally formed), and the buckle 3022 is disposed on an outer wall of the circular sealing edge 3021.

The female sealing unit 301 comprises a circular sealing slot 3011 and a clamping groove 3012 allowing the buckle 3022 to be clamped therein, wherein the circular sealing slot 3011 is fixed to the bottom surface of the sealing cover 2 (in this embodiment, the circular sealing slot 3011 and the sealing cover 2 are integrally formed), and the clamping groove 3012 is formed in an inner wall of the circular sealing slot 3011. When placed at the opening 101 of the box body 1, the sealing cover 2 is pressed downwards to force the circular sealing edge 3021 to be inserted into the circular sealing slot 3011 in the bottom surface of the sealing cover 2, the buckle 3022 is clamped in the clamping groove 3012, and the sealing cover 2 completely seals the opening 101 in the top end of the box body 1.

A quick opening mechanism 4 is further disposed between the box body 1 and the sealing cover 2 and comprises an opening base 401 and an opening element 402, wherein the opening base 401 is disposed at the top of an outer wall of the box body 1, two ends of the opening element 402 are an opening end 4021 and an operating end 4022 respectively, the middle (closer to the opening end 4021) of the opening element 402 is rotatably mounted on the edge of the sealing cover 2 (the edge of the sealing cover 2 is provided with two hinge seats 201 formed with hinge holes 2011, and two hinge shafts 4023 are disposed in the middle of the opening element 402 and are inserted into the hinge holes 2011 of the two hinge seats 201 respectively), the opening end 4021 is located on a top surface of the opening base 401, and the operating end 4022 is away from the top surface of the opening base 401. When the sealing cover 2 is to be opened, users pull the operating end 4022 to enable the operating end 4022 to rotate, and then the opening end 4021 presses against the top surface of the opening base 401 to force two parts, between the area where the opening end 4021 is located of the sealing cover 2 and the opening 101 of the box body 1, of the sealing mechanism 3 to be separated, so that the uses can perform further operations to open the sealing cover 2. Because the users cannot operate the sealing mechanism 3 when the sealing mechanism 3 is in the locked and sealed state, the quick opening mechanism 4 is configured to unlock the sealing mechanism 3 at a certain position to separate the parts of the sealing mechanism 3 at this position, so that the users can perform further operations at this position to completely unlock the sealing mechanism 3, and then the sealing cover 2 is completely disassembled. Based on the lever principle, the quick opening mechanism 4 simplifies the operations and destroys the locked and sealed state of the sealing cover 2 to allow the sealing cover 2 to be opened easily, quickly and effortlessly.

The opening element 402 is shaped like a straight plate, the opening end 4021 of the opening element 402 protrudes downwards, and a bottom surface of the operating end 4022 of the opening element 402 is close to a top surface of the sealing cover 2. In this embodiment, to make the overall appearance of the seal box more uniform, an opening element accommodating groove 202 which is concaved downwards is specially designed in the top surface of the sealing cover 2, and the opening element 402 is located in the opening element accommodating groove 202 in a non-open state. In this way, the opening element 402 can be supported by the top surface of the sealing cover 2, thus being prevented from shaking and being easy to store and carry.

A curved surface 40211 in smooth transition is disposed on an outer side of the opening end 4021 of the opening element 402. The curved surface 40211 in smooth transition can effectively protect the opening end 4021 against damage when the opening end 3021 contacts with the top surface of the opening base 401.

An oblique surface 40221 which inclines upwards is disposed at the bottom of the operating end 4022 of the opening element 402. Users can easily insert their fingers into a gap between the operating end 4022 of the opening element 402 and the top surface of the sealing cover 2 through the oblique surface 40221 to pull the operating end 4022 of the opening element 402 upwards.

The operating process is introduced below in conjunction with FIG. 1-FIG. 5:

When the seal box needs to be sealed, users place the sealing cover 2 over the opening 101 in the top end of the box body 1 and presses the sealing cover 2 downwards to force the circular sealing edge 3021 at the opening 101 in the top end of the box body 1 to be inserted into the circular sealing slot 3011 in the bottom surface of the sealing cover 2, and the buckle 3022 is clamped in the clamping groove 3012, so that the sealing cover 2 can completely seal the opening 101 in the top end of the box body 1.

When the seal box needs to be opened, users insert their fingers of one hand into the gap between the operating end 4022 of the opening element 402 and the top surface of the sealing cover 2 and then lift the operating end 4022 of the opening element 402 to enable the opening element 402 to rotate, and the opening end 4021 of the opening element 402 moves downwards, abuts against the top surface of the opening base 401 and then forces the area, where the opening element 402 is located, of the sealing cover 2 to move upwards to force the circular sealing slot 3011 to be separated from the circular sealing edge 3021, so that the sealing cover 2 is opened.

Tests prove that the seal box in this embodiment has an extremely good actual use effect and can be opened by users with a single hand easily, quickly and effortlessly.

Embodiment 2

Figure 6:
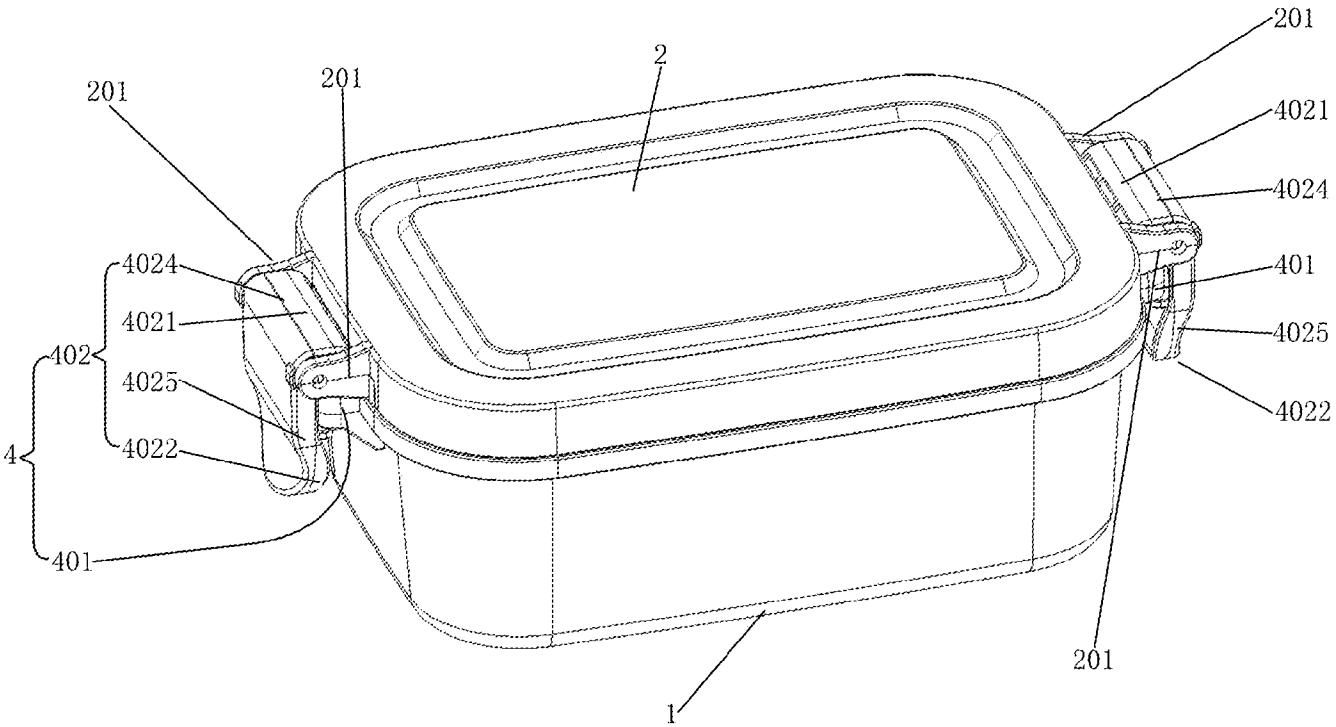
FIG. 6 is a structural diagram of Embodiment 2 of the invention.
Figure 7:
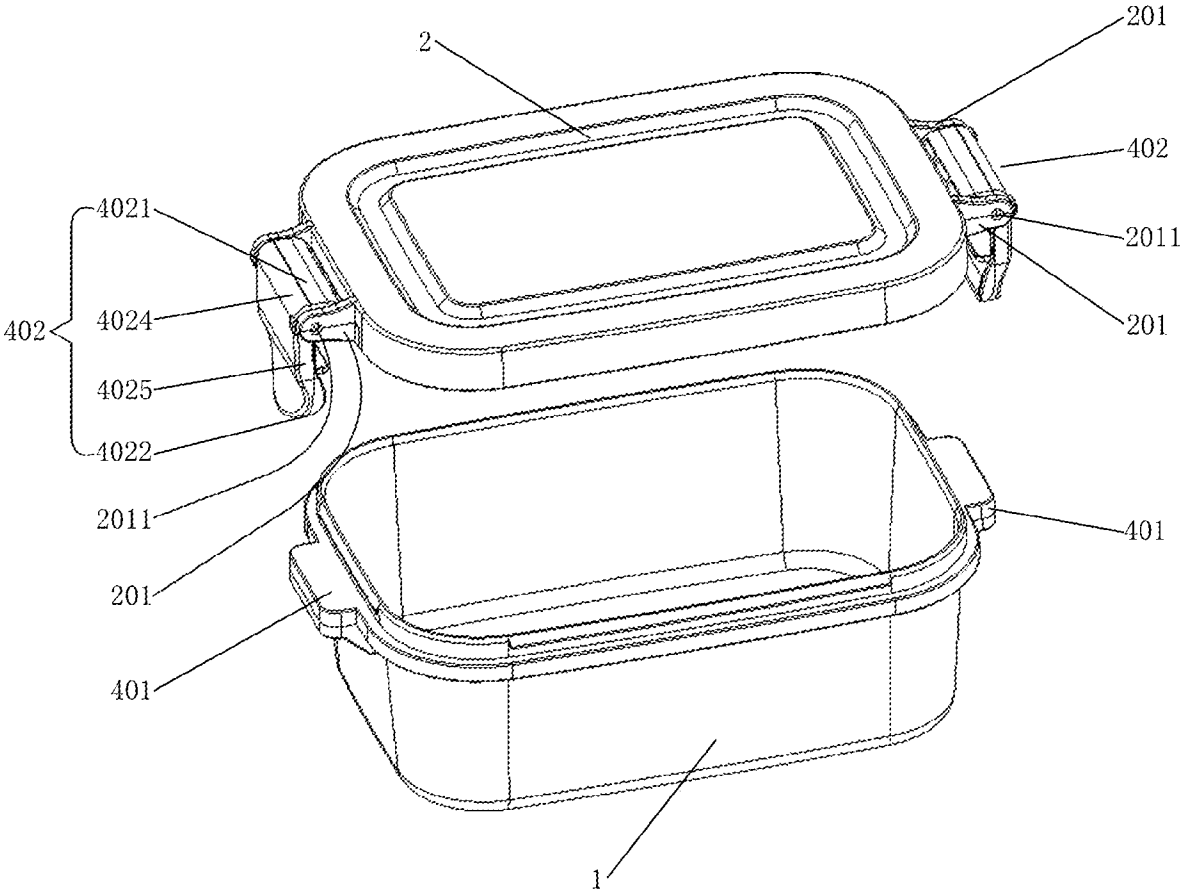
FIG. 7 is an exploded view of parts of Embodiment 2 shown in FIG. 6.
Figure 8:
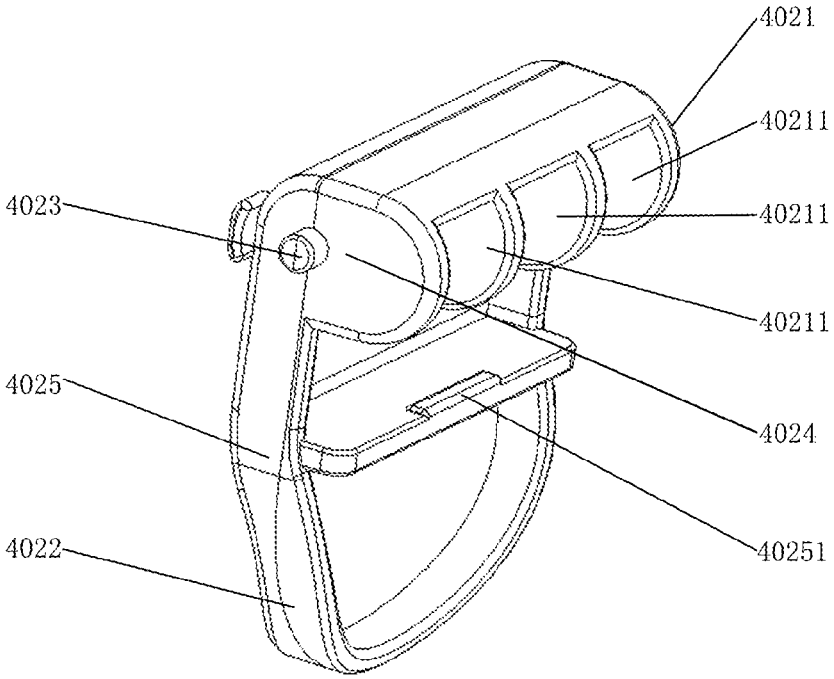
FIG. 8 is a structural view of an opening element in Embodiment 2 shown in FIG. 6.

As shown in FIG. 6-FIG. 8, the seal box with a good sealing effect and easy to open in this embodiment differs from the seal box in Embodiment 1 in the following aspects:

The opening element 402 is shaped like 7, the opening element 402 comprises an operating section 4025 extending vertically and an opening section 4024 extending horizontally, a corner of the opening element 402 is rotatably mounted on the edge of the sealing cover 2, the operating end 4022 of the opening element 402 is located at a bottom end of the operating section 4025, and the opening end 4021 of the opening element 402 is located at a tail end of the opening section 4024

The opening end 4021 of the opening element 402 is semi-cylindrical. By designing the opening end 4021 to be semi-cylindrical, the sliding friction between the opening end 4021 and the top surface of the opening base 401 makes operation smoother when the opening end 4021 presses against the top surface of the opening base 401, and the opening end 4021 is less likely to be damaged.

The opening end 4021 is formed with a plurality of grooves 40211, so that materials can be effectively saved.

A locking piece 40251 for locking the bottom surface of the opening base 401 is disposed on an inner wall of the operating section 4025. When the operating section 4025 is vertically downwards and is in a non-open state, the locking piece 40251 locks the bottom surface of the opening base 401, so that the opening element 402 is prevented from shaking and is easy to store and carry.

The operating process is very simple. Users just need to pull the operating end 4022 to enable the opening element 402 to rotate to force the opening end 4021 to press against the top surface of the opening base 401, and then the area, where the opening element 402 is located, of the sealing cover 2 is forced to move upwards to force the circular sealing slot 3011 to be separated from the circular sealing edge 3021, so that the sealing cover 2 is opened.

Embodiment 3

Figure 9:
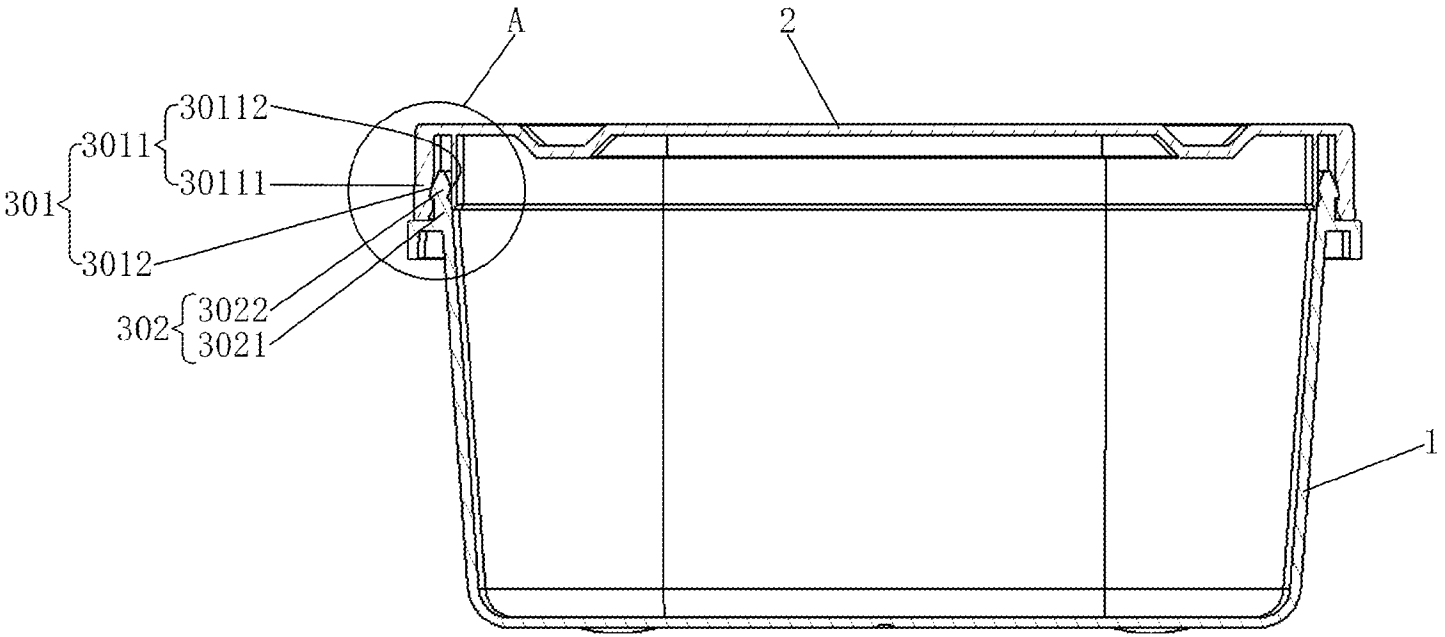
FIG. 9 is a sectional view of Embodiment 3 of the invention.
Figure 10:
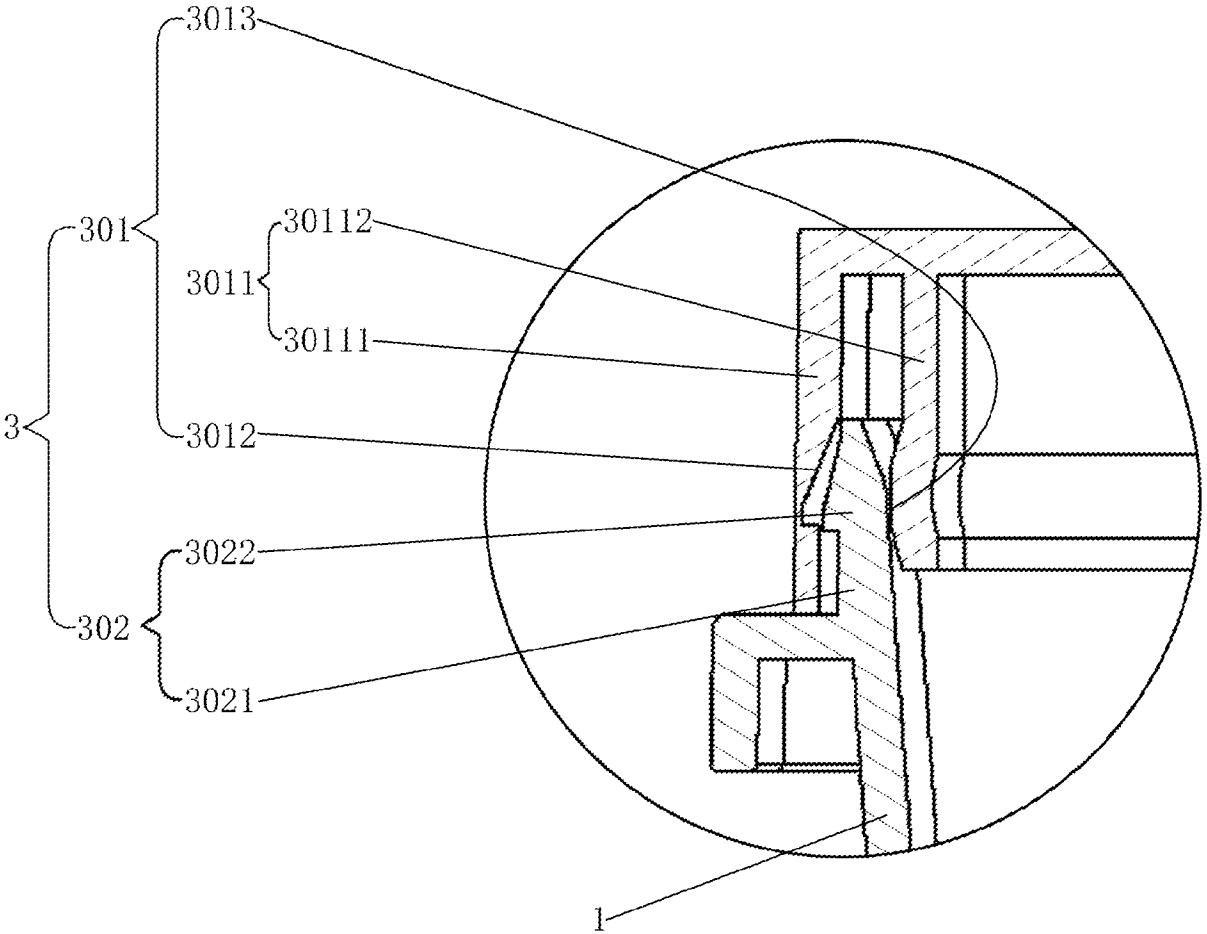
FIG. 10 is an enlarged view of part A in FIG. 9.

As shown in FIG. 9 and FIG. 10, the seal box with a good sealing effect and easy to open in this embodiment differs from the seal box in Embodiment 1 in the following aspects:

The circular sealing slot 3011 of the female sealing unit 301 comprises an outer slot plate 30111 and an inner slot plate 30112, the clamping groove 3012 is formed in an inner wall of the outer slot plate 30111, and a curved sealing surface 3013 capable of abutting and pressing against an inner wall of the buckle 3022 is disposed on an inner wall of the inner slot plate 30112. When the sealing cover 2 is placed at the opening 101 of the box body 1, the sealing cover 2 is pressed downwards to force the circular sealing edge 3021 to be inserted into the circular sealing slot 3011 in the bottom surface of the sealing cover 2, the buckle 3022 is clamped in the clamping groove 3012, and at this moment, the curved sealing surface 3013 abuts and presses against the inner wall of the buckle 3022, so that the sealing effect of the sealing cover 2 is better. Tests prove that good sealing performance can be guaranteed even if the seal box is inclined, inverted or shaken.

FIG. 9 is a horizontal sectional view in which the quick opening mechanism 4 cannot be seen.

In addition, it should be noted that the names of all parts in the specific embodiments described in the specification may be different. All equivalent or simple transformations made based on the structures, features and principles of the conception of the invention should also fall within the protection scope of the invention. Those skilled in the art can make different amendments, supplements or similar substations to the specific embodiments described above, and all these different amendments, supplements or similar substations obtained without departing from the structures of the invention or going beyond the scope defined by the claims should also fall within the protection scope of the invention.

What is claimed is:

1. A seal box with a good sealing effect and easy to open, comprising a box body and a sealing cover, the box body being formed with an opening, a sealing mechanism being disposed between the opening of the box body and the sealing cover, the sealing cover being detachably mounted at the opening of the box body, the sealing mechanism being in a locked and sealed state, wherein a quick opening mechanism is further disposed between the box body and the sealing cover and comprises an opening base and an opening element, the opening base is disposed at a top of an outer wall of the box body, a middle of the opening element is rotatably mounted on an edge of the sealing cover, two ends of the opening element are an opening end and an operating end respectively, the opening end is located on a top surface of the opening base, and the operating end is away from the top surface of the opening base; when the sealing cover is to be opened, a user pulls the operating end to enable it to rotate, and then the opening end presses against the top surface of the opening base to force parts, between an area where the opening end is located of the sealing cover and the opening of the box body to be separated to allow the user to perform further operations to open the sealing cover, wherein the opening element is shaped like a straight plate, the opening end of the opening element protrudes downwards, and a bottom surface of the operating end of the opening element resists a top surface of the sealing cover, an opening element accommodating groove which is concaved downwards is specially designed in the top surface of the sealing cover, and the opening element is located in the opening element accommodating groove in a non-open state.

2. The seal box with a good sealing effect and easy to open according to claim 1, wherein a curved surface in smooth transition is disposed an outer side of the opening end of the opening element.

3. The seal box with a good sealing effect and easy to open according to claim 1, wherein an oblique surface inclining upwards is disposed at a bottom of the operating end of the opening element.

4. The seal box with a good sealing effect and easy to open according to claim 1, wherein the sealing mechanism comprises a female sealing unit and a male sealing unit, the male sealing unit is disposed at the opening of the box body, and the female sealing unit is disposed on a bottom surface of the sealing cover.

5. The seal box with a good sealing effect and easy to open according to claim 4, wherein the male sealing unit comprises a circular sealing edge and a buckle, the circular sealing edge is fixed to the opening of the box body, and the buckle is disposed on an outer wall of the circular sealing edge; and the female sealing unit comprises a circular sealing slot and a clamping groove allowing the buckle to be clamped therein, the circular sealing slot is fixed to the bottom surface of the sealing cover, and the clamping groove is formed in an inner wall of the circular sealing slot.

6. The seal box with a good sealing effect and easy to open according to claim 1, wherein a top surface of the operating end of the opening element is coplanar with the top surface of the sealing cover.

* * * * *